US005727257A

United States Patent [19]

Chen

[11] Patent Number: 5,727,257

[45] Date of Patent: Mar. 17, 1998

[54] GOALKEEPER'S GLOVE FOR TRAPPING FOOTBALL

[76] Inventor: Yi-Yi Chen, P.O. Box 55-846, Taipei, Taiwan

[21] Appl. No.: 851,002

[22] Filed: May 5, 1997

[51] Int. Cl.[6] ..... A41D 19/00

[52] U.S. Cl. ..... 2/161.1; 2/159; 2/160

[58] Field of Search ..... 2/158, 159, 161.1, 2/160, 161.6, 161.8

[56] References Cited

U.S. PATENT DOCUMENTS 3,096,523 7/1963 Bruchas ..... 2/159

4,071,913 2/1978 Rector ..... 2/161.1

*Primary Examiner*—Gloria M. Hale

[57] ABSTRACT

A goalkeeper's glove includes a trapping protrusion formed on an inside or palm cover of the glove having a plurality of arcuate extensions gradationally and concentrically formed on the glove adjacent to a palm center of the glove for efficiently catching, retarding, and trapping a football when kicked from an attack kicker.

4 Claims, 4 Drawing Sheets

GOALKEEPER'S GLOVE FOR TRAPPING FOOTBALL

BACKGROUND OF THE INVENTION

A conventional goalkeeper's glove with foam rubber padding coated on the glove may help a goalkeeper to catch football as kicked by an attack kicker. However, such a rubber padding is generally coplanar or parallel to the surface layer of the glove cover and can not efficiently clutch a football especially when flying from a sideward direction, thereby failing to save the ball enterring the goal.

The present inventor has found the drawbacks of a conventional goalkeeper's glove and invented the present glove for efficiently trapping a football within the glove.

SUMMARY OF THE INVENTION

The object of the present invention is to provide a goalkeeper's glove including a trapping protrusion formed on an inside or palm cover of the glove having a plurality of arcuate extensions gradationally and concentrically formed on the glove adjacent to a palm center of the glove for efficiently catching, retarding, and trapping a football when kicked from an attack kicker.

DETAILED DESCRIPTION

Figure 1:
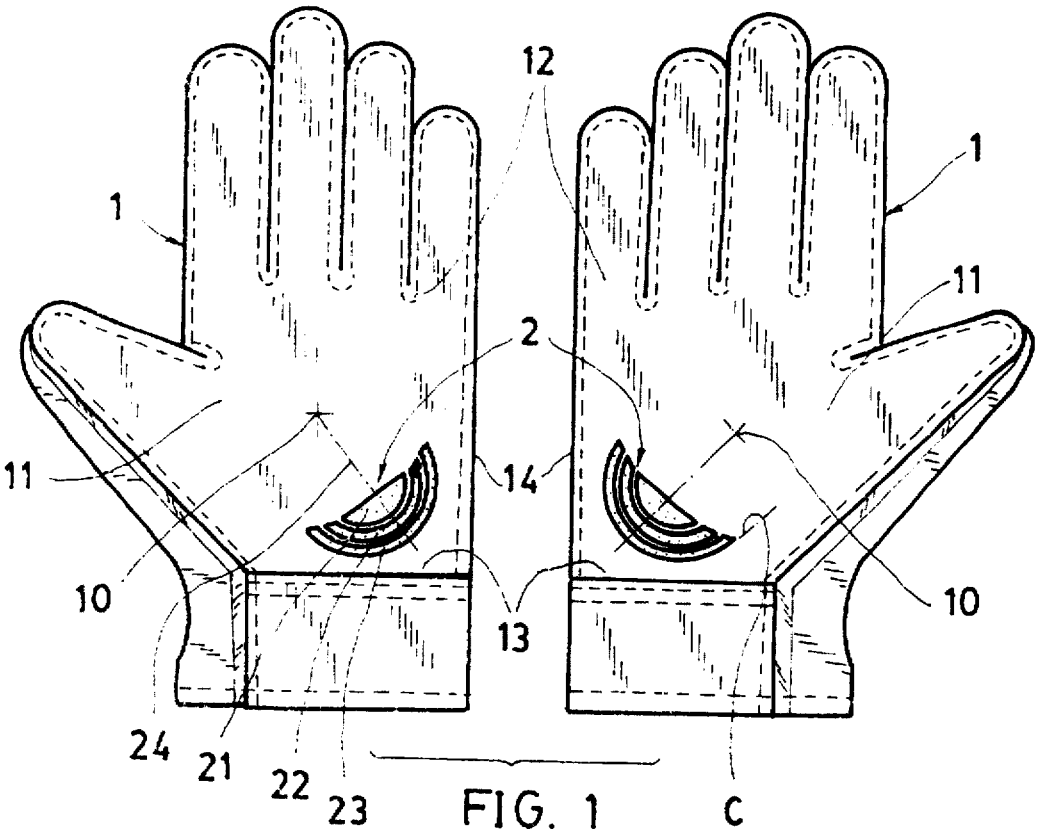
FIG. 1 is an illustration showing a pair of goalkeeper's gloves in accordance with the present invention.

As shown in FIGS. 1 –8, a goalkeeper's glove of the present invention comprises: a glove i and a trapping protrusion 2 formed on the glove 1.

The glove 1 is formed by combining an inside (or palm) cover 11 and a back cover 11' to be worn by one's hand, having a protrusion hole 15 generally semi-circular or half-moon shaped and formed in the inside cover 11; with the protrusion hole 15 defined within a palm center 10 located at a center of a palm portion of the inside cover 11, a little-finger sheath 12, a wrist portion 13 and an ulnar-side edge portion 14.

The trapping protrusion 2 may be made of rubber or other elastomer materials and fixed, adhered, embedded or integrally formed on the inside cover 11 of the glove 1. The shape of the trapping protrusion 2 is preferably formed as a semi-circular shape as illustrated, but not limited in the present invention.

The trapping protrusion 2 may be made of frictional elastomer material and includes: a base portion 20; a plurality of arcuate extensions 21, 22, 23 gradationally and concentrically formed on the base portion 20 to be formed or secured on the inside cover 11 of the glove 1, with the arcuate extensions 21, 22, 23 gradationally declined towards the palm center 10 and symmetrically disposed about a radial center line 24 radially intersecting a central portion of each arcuate extension 21, 22, 23 each arcuate extension 21, 22, 23 defining a curvature C having a curvature center 25 (FIG. 6) located adjacent to the palm center 10 of the glove 1; and each arcuate extension 21, 22, 23 concaved inwardly towards the palm center 10; and the trapping protrusion 2 engaged with the protrusion hole 15 in the inside cover 11 of the glove and confined within the palm center 10, the little-finger sheath 12, the wrist portion 13, and the ulnar-side edge portion 14 of the glove 1.

The base portion 20 of the trapping protrusion 2 is generally semi-circular or half-moon shaped, having a base flange 201 circumferentially disposed around the base portion 20 to be adhered or secured to an edge portion surrounding the protrusion hole 15 in the glove 1 (FIG. 4) to protrude the plurality of arcuate extensions 21, 22, 23 beyond the inside cover 11 of the glove 1 for trapping and clutching a football B when worn by the goalkeeper.

Figure 10:
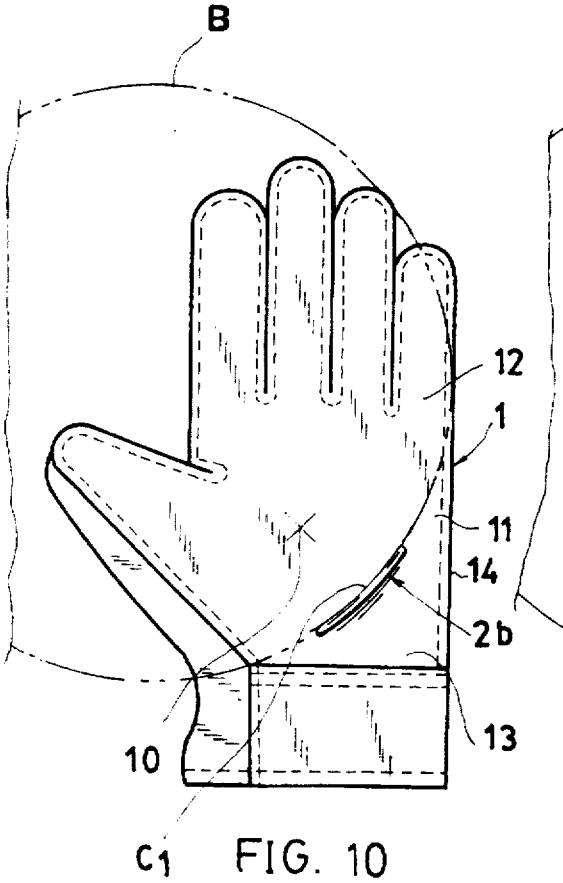
FIG. 10 shows still another preferred embodiment of the present invention.
Figure 9:
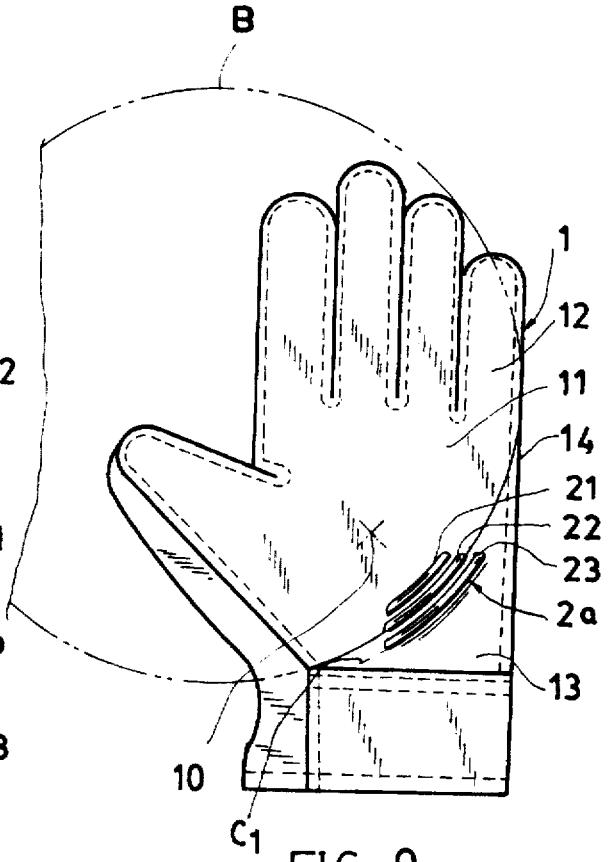
FIG. 9 is a front view of another preferred embodiment of the present invention.

The arcuate extensions may be integrally formed with the inside cover 11 of the glove 1 as shown in FIG. 9 in which three arcuate extensions 21, 22, 23 of the trapping protrusion 2*a* are formed on the glove 1, and in FIG. 10 in which only one arcuate extension of the protrusion 2*b* is formed on the glove 1. The curvature C1 of the arcuate extension of the trapping protrusion 2*a*, 2*b* may be same as that of a football B, but not limited in the present invention.

Figure 2:
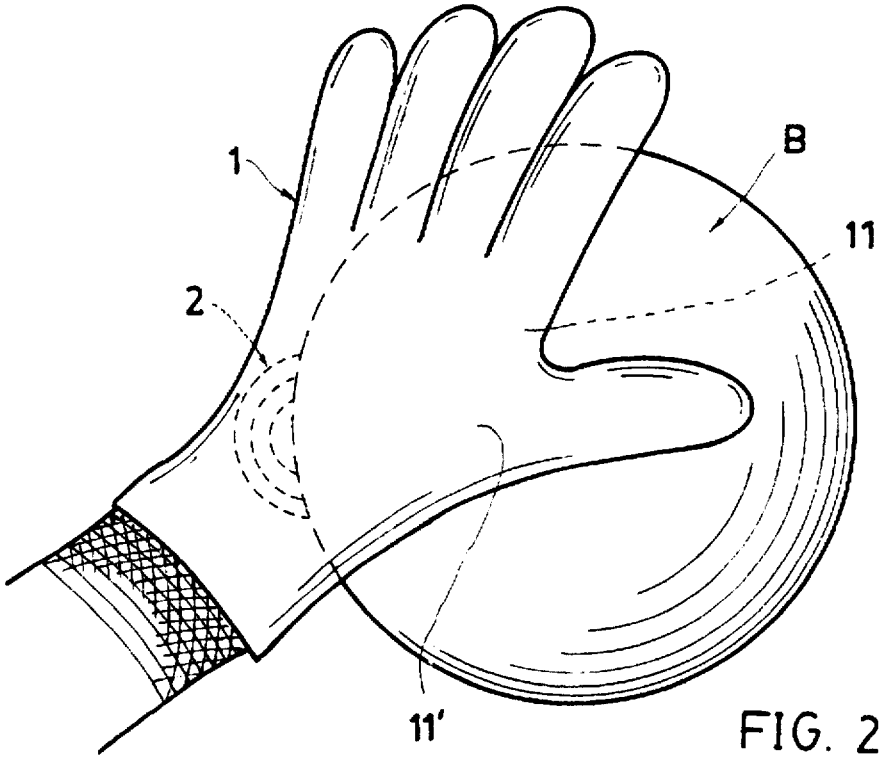
FIG. 2 is an illustration showing a trapping action by a keeper's single hand when wearing the glove of the present invention.
Figure 3:
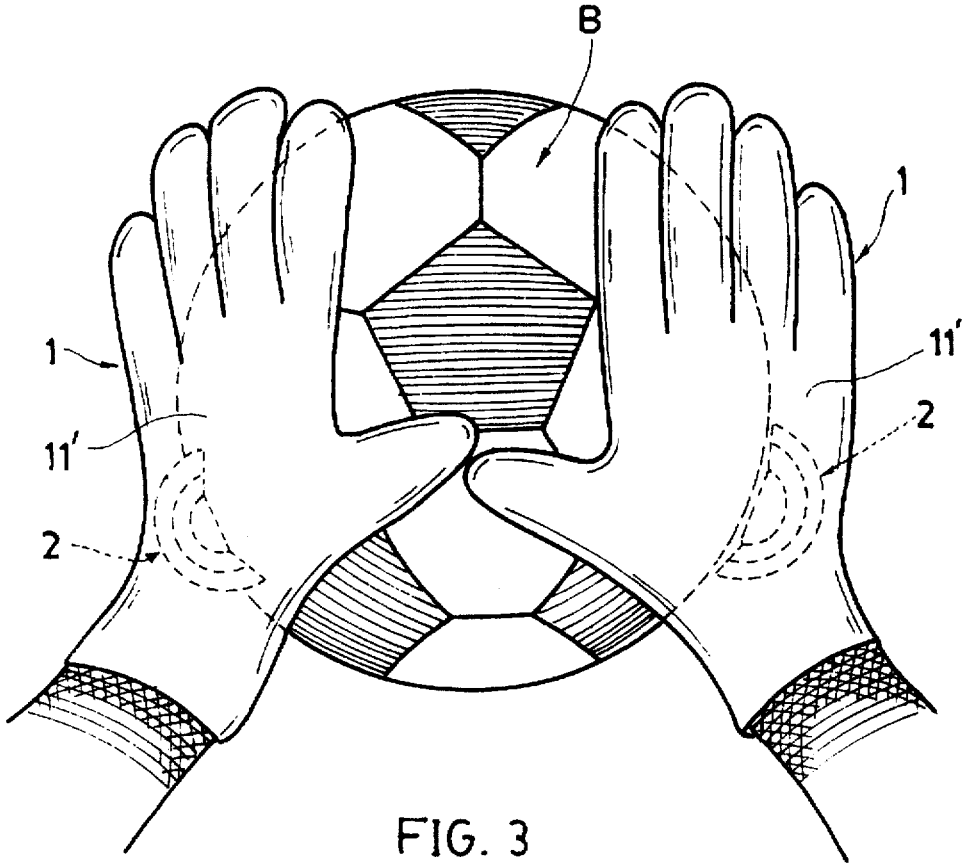
FIG. 3 shows a football as caught by a pair of gloves of the present invention.
Figure 4:
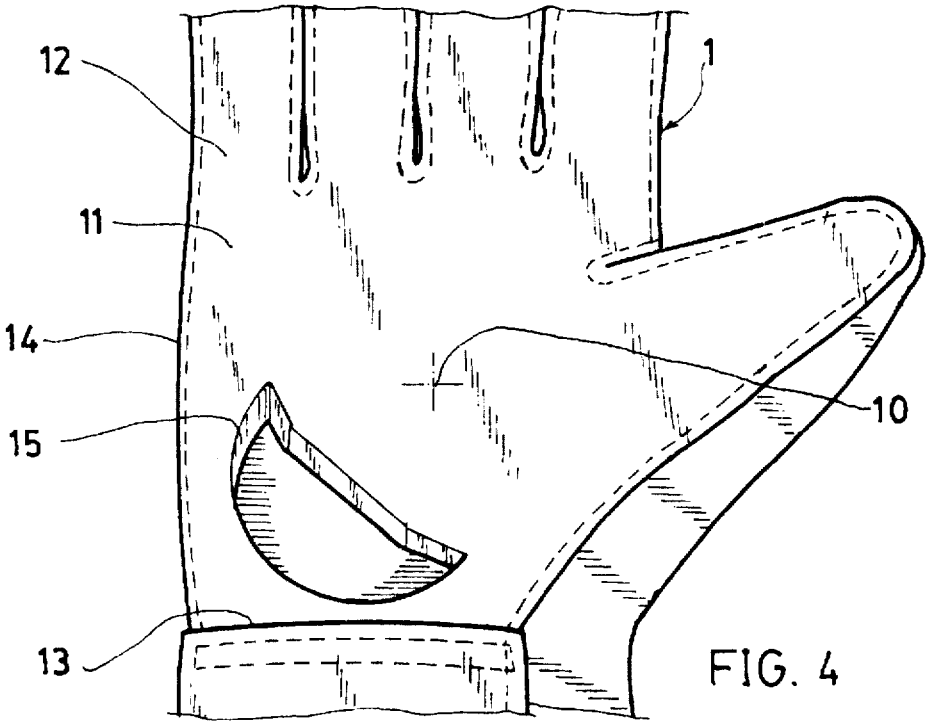
FIG. 4 shows a first step for making the present invention having a protrusion hole formed in the glove.
Figure 5:
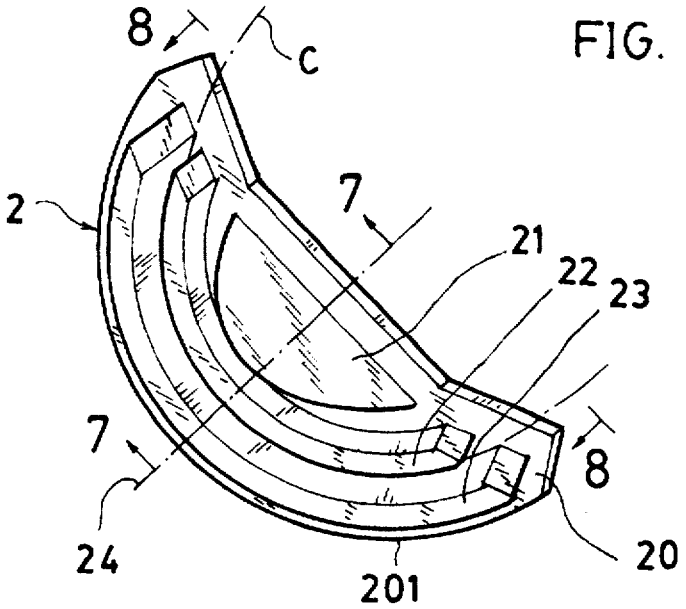
FIG. 5 is an illustration of the trapping protrusion in accordance with the present invention.
Figure 6:
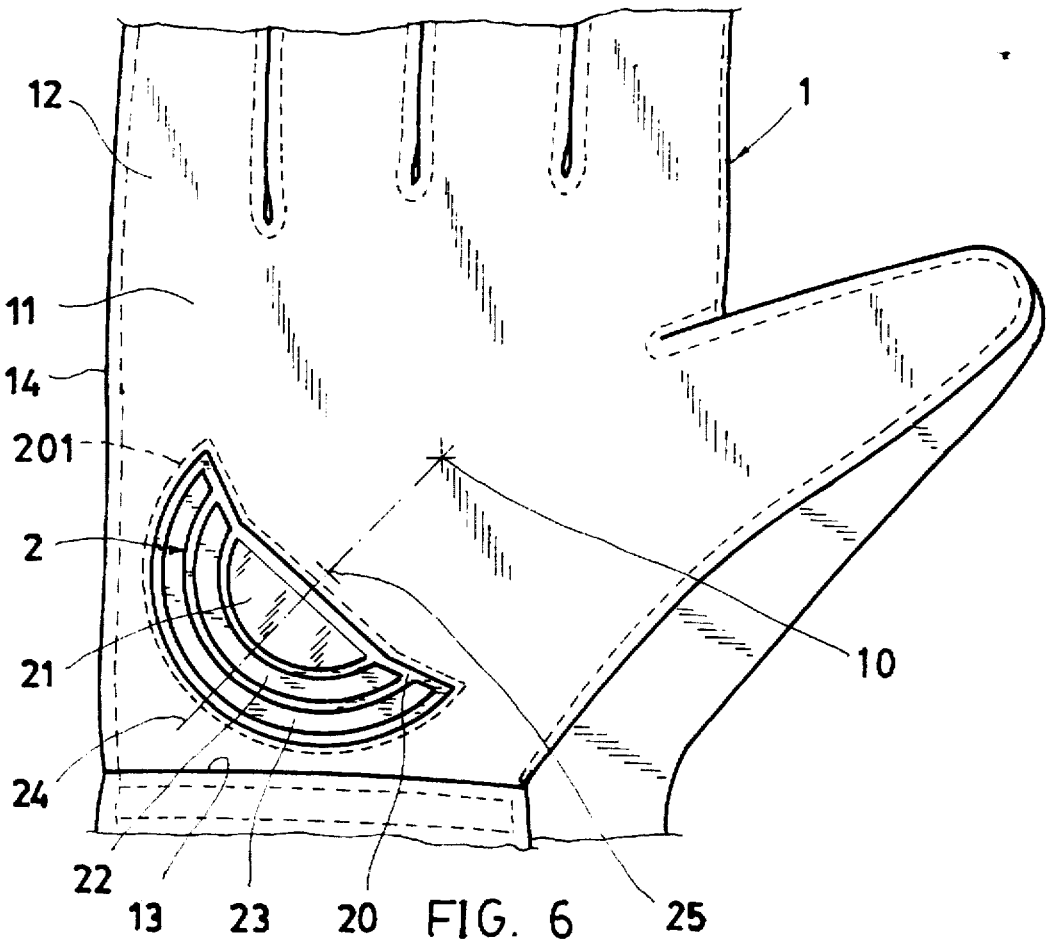
FIG. 6 is an illustration of the glove as formed by fixing the trapping protrusion into the protrusion hole as shown in FIG. 4.
Figure 7:
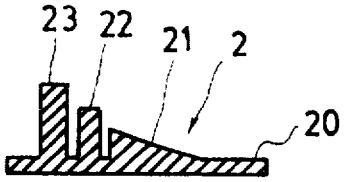
FIG. 7 is a radial sectional drawing of the trapping protrusion when viewed from 7—7 direction of FIG. 5.
Figure 8:
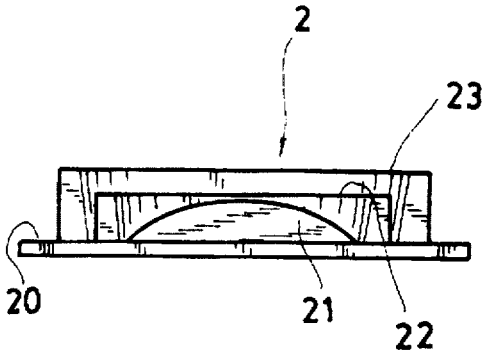
FIG. 8 is a side view of the trapping protrusion when viewed from 8 —8 direction of FIG. 5.

When wearing the gloves of the present invention as shown in FIGS. 2, 3, the trapping protrusion 2 formed on the inside cover 11 of the glove 1 will frictionally retard, trap, and block a football when caught on the palm portion of the glove 1 by the plural arcuate extensions 21, 22, 23 arcuately and concentrically formed on the inside cover 11 of the glove 1 to prevent a sideward escape or slipping of the football from the inside surface of the glove 1, thereby being superior to the conventional goalkeeper's glove having flat rubbing padding adhered on the glove.

The present invention may be modified without departing from the spirit and scope of the present invention. The shapes, curvatures, heights, materials, and number of the arcuate extensions and of the trapping protrusion are not limited in this invention.

I claim:

1. A goalkeeper's glove comprising:

a glove formed by combining an inside cover and a back cover, having a palm center defined at a center of a palm portion of the inside cover; and a trapping protrusion formed on the inside cover of the glove and located among the palm center, a little-finger sheath, a wrist protion and an ulnar-side edge portion of the glove; said trapping protrusion including: a base portion; a plurality of arcuate extensions gradationally and concentrically formed on the base portion which is secured on the inside cover of the glove, with said arcuate extensions gradationally declined towards the palm center and symetrically disposed about a radial center line radially intersecting a central portion of each said arcuate extension; each said arcuate extension defining a curvature having a curvature center located adjacent to the palm center of the glove; and each said arcuate extension concaved inwardly towards the palm center for helping catching and clutching a football when caught by the glove as worn on a goalkeeper's hand.

2. A goalkeeper's glove according to claim 1 wherein said base portion of the trapping protrusion is generally semi-circular shaped, having a base flange circumferentially disposed around the base portion to be secured to an edge portion surrounding a protrusion hole formed in the glove to protrude the plurality of arcuate extensions through the protrusion hole beyond the inside cover of the glove for catching the football.

3. A goalkeeper's glove according to claim 2 wherein said protrusion hole formed in said inside cover of said glove is generally semi-circular shaped; with the protrusion hole defined within a palm center, a little-finger sheath, a wrist portion and an ulnar-side edge portion of the glove.

4. A goalkeeper's glove according to claim 1, wherein said trapping protrusion includes: a plurality of arcuate extension integrally formed on the inside cover of the glove, with said arcuate extensions gradationally and concentrically formed on said inside cover of said glove and defined among the palm center, the little-finger sheath, the wrist portion and the ulnar-side edge portion of the glove.

* * * * *